US010883727B2

(12) United States Patent
Haemerle

(10) Patent No.: US 10,883,727 B2
(45) Date of Patent: Jan. 5, 2021

(54) FREESTANDING PORTABLE SPLATTER SHIELD

(71) Applicant: Richard R. Haemerle, Valley Park, MO (US)

(72) Inventor: Richard R. Haemerle, Valley Park, MO (US)

( * ) Notice: Subject to any disclaimer, the term of this patent is extended or adjusted under 35 U.S.C. 154(b) by 129 days.

(21) Appl. No.: 16/163,151

(22) Filed: Oct. 17, 2018

(65) Prior Publication Data

US 2020/0124292 A1 Apr. 23, 2020

(51) Int. Cl.
*F24C 15/12* (2006.01)

(52) U.S. Cl.
CPC ..... *F24C 15/12* (2013.01)

(58) Field of Classification Search
USPC ..... 126/214 D
See application file for complete search history.

(56) References Cited

U.S. PATENT DOCUMENTS

| | | | | |
|---|---|---|---|---|
| 2,591,786 | A * | 4/1952 | Cronheim | F24C 15/36 160/135 |
| 2,836,171 | A | 5/1958 | Cripe | |
| 3,236,405 | A | 2/1966 | McFadden et al. | |
| 4,123,822 | A | 11/1978 | Bentley | |
| 4,237,856 | A | 12/1980 | Trombatore | |
| 4,422,441 | A | 12/1983 | Schoepe | |
| 4,852,213 | A | 8/1989 | Shewchuk | |
| 5,189,257 | A | 2/1993 | Borgmeyer et al. | |
| 5,351,673 | A | 10/1994 | Somerton | |
| 5,813,396 | A | 9/1998 | Bessette | |
| 6,371,105 | B1 | 4/2002 | Merritt | |
| 6,866,035 | B2 | 3/2005 | Haemerle | |
| 6,973,927 | B1 * | 12/2005 | Stewart | A47J 37/0786 126/201 |
| 7,411,153 | B2 * | 8/2008 | Radtke | B23K 9/10 16/266 |
| 2004/0173201 | A1 * | 9/2004 | Haemerle | F24C 15/12 126/299 C |
| 2006/0201959 | A1 | 9/2006 | Hornbeck | |

FOREIGN PATENT DOCUMENTS

DE 20302542 U1 6/2003

* cited by examiner

*Primary Examiner* — Avinash A Savani
(74) *Attorney, Agent, or Firm* — Husch Blackwell LLP

(57) ABSTRACT

A splatter shield including a central panel, two extension panels, and two end panels, the extension panels being selectively movable to increase or decrease the length of the central panel, one end of each extension panel including a 90° flange member having at least one slot extending therethrough, one end of each of end panel including at least one curved member configured so as to be received by the at least one slot associated with the 90° flange members for selectively positioning the end panels at a plurality of different angular orientations to accommodate different work areas. The end panels are further movable to a position wherein they can be disengaged from the extension panels and the extension panels can be removed from the central panel. The present splatter shield can also be utilized without the extension panels, the 90° flange members being associated with the central panel.

15 Claims, 9 Drawing Sheets

FREESTANDING PORTABLE SPLATTER SHIELD

BACKGROUND OF INVENTION

The present invention relates generally to splatter guards and shield assemblies and, more particularly, to an improved all-purpose portable, freestanding, and adjustable splatter shield for use in kitchens and other areas.

Splatter shields for use in kitchens are well known. They are typically constructed to be used on or about a stovetop and attach permanently or semi-permanently to the stove. An example of such a splatter shield can be found in U.S. Pat. No. 5,351,673. This device is referred to as a spatter guard for use with a recreational vehicle (RV) stove. It attaches to a hinged cover that overlies the burners on the stove and can only be used when the burner cover is in an elevated position exposing the burners for use. The spatter guard includes two wings each positionable at opposite sides of the stove, each wing being attachable to an opposite end of the burner cover. Such a spatter guard is dedicated for use with a stove having a burner cover and on its own is not freestanding.

Other forms of known spatter guards attach to the front of a stove, either permanently or semi-permanently, and are used to shield a person from forward splattering and/or accidental contact with the burners. For example, U.S. Pat. No. 5,813,396 discloses such a guard device which attaches to the front of the stove and extends above the range top surface a sufficient distance to deflect hot food particles emitted during cooking so as to prevent such food particles from being projected outwardly beyond the front plane of the stove. This device does not protect the stove or kitchen area from spattering to the sides or rear of the stove or other areas.

U.S. Pat. No. 4,237,856 discloses a pair of splatter screens which are built into or are attachable to the sides of a stove adjacent the burners. The screens are retractable into the frame associated with the stove but do not protect a spattering to the rear or other locations relative to the stovetop.

Another form of spatter guard is found in U.S. Pat. No. 6,371,105. This device involves the use of burner covers, a stove control cover and a rear panel that is foldable to cover the rear burners. This shield is hingedly attachable to a stove via a frame that is mounted to the stove top.

Another splatter shield is disclosed in U.S. Pat. No. 4,422,441. This splatter shield is collapsible and includes a series of pleated metal foil panels which collapse flat in accordion fashion for storage. While portable and usable at various locations, the accordion style pleated shield is awkward, difficult to manipulate and maneuver, difficult to position in certain work areas, and difficult to clean and maintain sanitary because of its pleated construction. Also, importantly, the end panels are not angularly adjustable relative to the central back panel.

Splattering or spattering can occur at various locations in the kitchen when working, particularly in and around the stove area. Stoves however come in various shapes and sizes and can be located at various positions in a kitchen. This makes it difficult to provide for a somewhat universally adaptable splatter shield. None of the above-described splatter shields are readily adaptable for use with the different and varying sizes and styles of stoves available today. Further, they are not adaptable for use in other locations within a kitchen, for example, at a sink or on a countertop where food is being prepared and processed. Further, they are not adaptable for use with portable cooking devices, for example, an electric skillet, wok, food processor and so forth.

Another problem with the above-described splatter shields is that they are not easily foldable and adaptable for easy storing as a complete unit nor are they adjustable to accommodate varying appliances and cooking or food preparation locations. Typically, storage space in a kitchen is at a premium and any device needs to be easily storable without taking up unnecessary storage space.

U.S. Pat. No. 6,866,035 discloses a prior freestanding portable splatter shield invented by the present applicant. Although this splatter shield solves many of the problems associated with the above-referenced prior art splatter shields, it includes a much more complicated structure and a non-removable hinge arrangement which impedes cleaning of the overall unit. Because the central panel includes respective receptacles within the wall or structure as best illustrated in FIG. 7, and because the retention mechanism of FIG. 8 prevents the extension members 20 from being fully disengaged from the central panel, dirt, grease and other debris and food particles may collect within the spaces within the central panel and adequate cleaning of the overall unit becomes more difficult. In addition, since the preferred hinge arrangement is preferably integral with the extension member and end panels such as through the use of a flexible non-mechanical anamorphic type hinge (a thin web of plastic material), this hinge arrangement is susceptible to breakage over a period of time thereby rendering the splatter shield useless or ineffective.

Thus, there is a need for an improved splatter shield for use in kitchens and other food processing areas.

SUMMARY OF INVENTION

The present invention relates to a splatter shield which includes a central panel, a pair of extension panels and a pair of end panels that are selectively foldable in an overlying relationship to the central panel and to the extension panels for storage and are positionable at a multitude of different angular orientations extending outwardly from the central panel for use in a freestanding manner A stove or other kitchen appliance such as a wok, electric skillet, mixer and so forth may be positioned in the space between the end panels and central panel providing a shield on three sides of a work area. The central panel may comprise a wall member having extension members associated therewith which are movably mounted thereto for adjusting the length of the central panel in a selective manner. The end panels are hingedly connected to the extension members and preferably the hinged connection is accomplished through a removable hinge connection as will be hereinafter further explained. The hinge connection is constructed such that the two end panels will lie generally flat and parallel to the central panel and to the pair of extension panels in an overlaying relationship when the end panels are folded into their storage position but the end panels will disengage from their respective extension panels when moved to a certain position as will be further explained. The splatter shield can be made of a variety of different materials including any type of metal material as well as a molded polymeric material for lightness in weight, easy cleaning and imperviousness to degradation by cleaners and food products.

More particularly, the present splatter shield includes an improved hinge connection which includes a 90° flange member located at the end of each of the extension panels, each 90° flange member having at least one and preferably a plurality of slots extending through the flange member. Each end of each of the end panels has at least one and preferably a corresponding plurality of curved members that fold back towards the end panel but stop short of the end panel forming a gap therebetween. The curved members are dimensioned so as to be received by the slots associated with the respective 90° flange members. In use, the 90° flange member on each of the extension panels is positioned in a corresponding gap associated with each end panel and each end panel is then rotated so that the curved member(s) are received within the slot(s) associated with each of the 90° flange members thereby allowing the end panels to rotate relative to the extension panels between a position where the end panels lie flat on top of the extension members and central panel, and a position angularly related thereto. When the end panels are rotated so as to lie in the same plane as the 90° flange member, the end panels will disengage from the extension members. This allows the end panels to be separately clean separate and apart from the extension members and the central panel.

In addition, the extension members are slidably received within channels associated with the top and bottom edge portions of the central panel and are likewise completely removable from the central panel. This enables the entire splatter shield, namely, the central panel, the pair of extension members, and the pair of end panels to be separately removed from the assembled splatter shield and to be individually cleaned one member at a time.

The present splatter shield therefore represents an all-purpose improved kitchen splatter type barrier which can be used in any work location involving the preparation of food, cooking, or even other applications such as for use in preventing splatter associated with stove tops, around sink areas, while using a multitude of different types of electrical appliances such as cooking with electric skillets, woks, griddles or portable grills, preparing food with food processors and electric mixers, preparing foods on countertops and cutting boards, and many additional applications. The present splatter shield is expandable and adjustable to fit any stove top or other working location and its end panels are likewise angularly adjustable to again accommodate the size and space associated with the particular working location. In one embodiment, the present splatter shield may be constructed of materials which are fire and heat resistant, bacteria resilient, non-porous and non-absorbent, and it may include non-stick surfaces. The present splatter shield is portable, freestanding and lightweight so that it can be easily moved from one work location to another such as for use behind a sink area for preparing messy foods or cleaning pots and pans, for use on countertops for appliances that splatter during the cooking process, and for use with electric appliances such as woks, stir fries and grills that produce hot grease or splatter during the cooking process. In addition, because of its foldability and removability of components, the present splatter shield can be quickly and easily removed from the work area, easily folded into its storage position for compact storage when not in use, and easily cleaned.

It is also recognized and anticipated that the present splatter shield can be used in many other different applications such as, for example, for use as (1) a paint splatter shield to contain a painting operation within a specific area and to prevent any over-spray, paint splatter and/or coverage beyond the splatter shield, for use as (2) a work space enclosure, for use as (3) a containment for any spray type application, or any other enclosure type application. Other uses and applications will become apparent to those skilled in the art.

DETAILED DESCRIPTION

Figure 1:
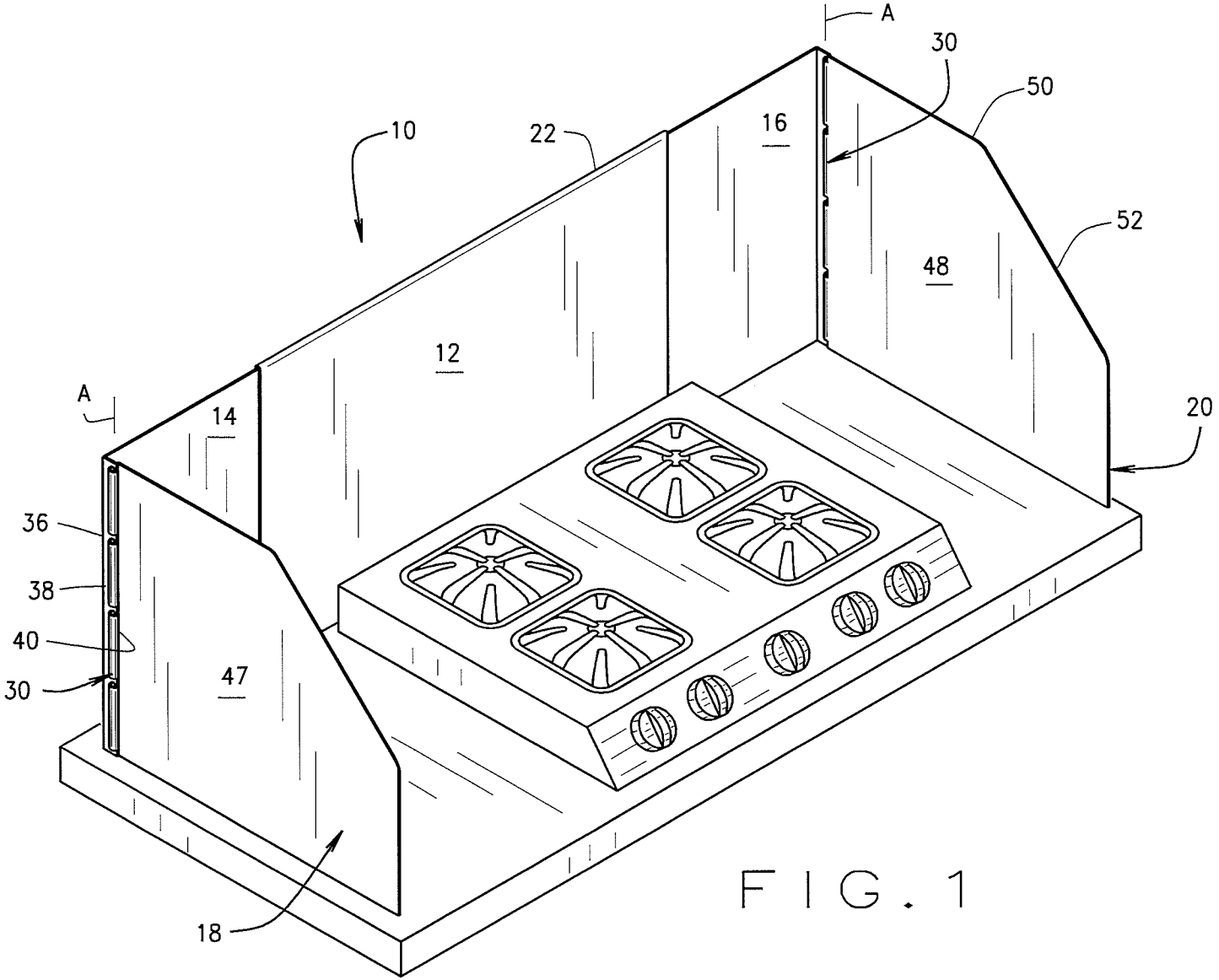
FIG. 1 is a perspective view of one embodiment of the present splatter shield shown in combination with a conventional stovetop.
Figure 2:
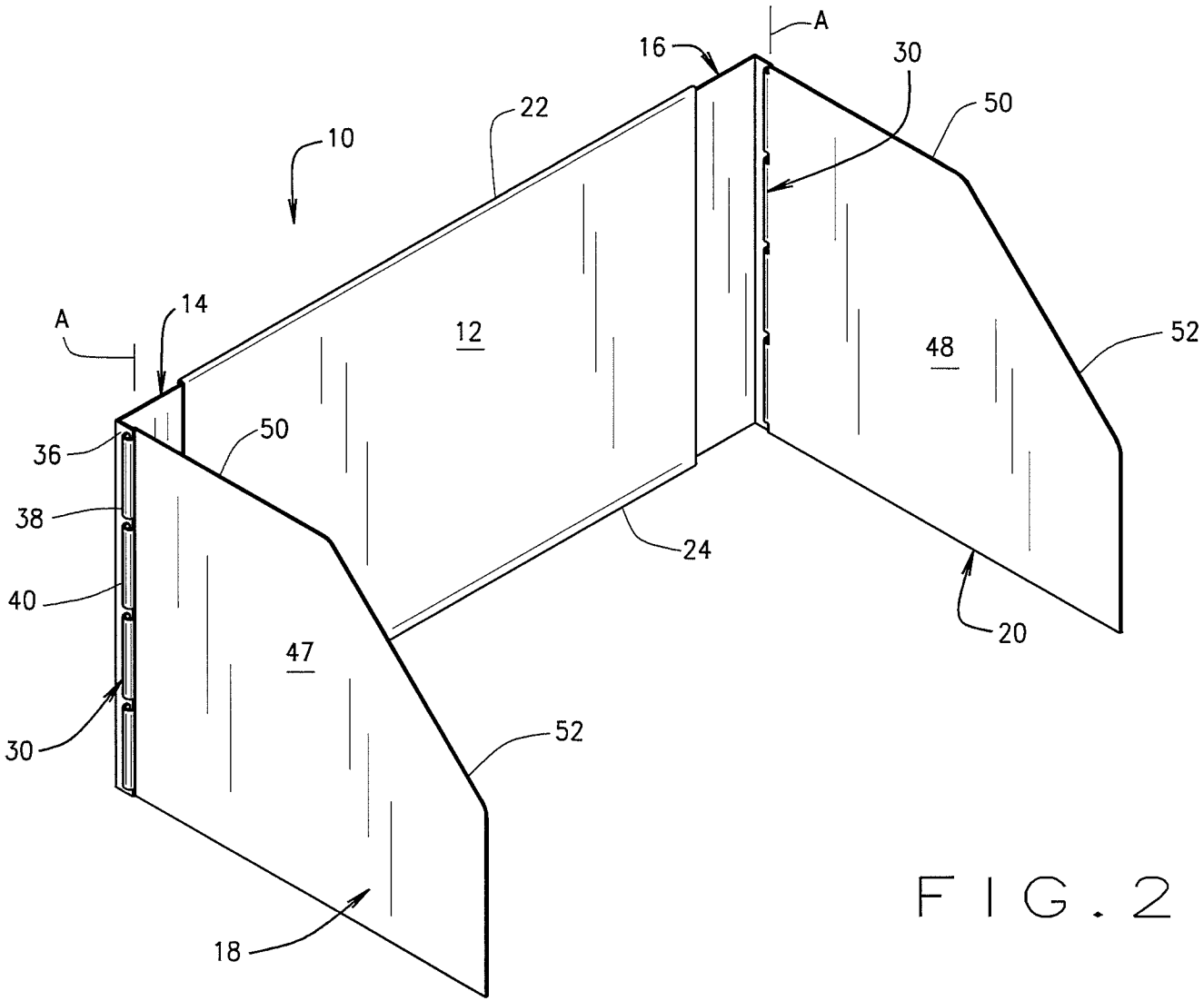
FIG. 2 is a perspective view similar to FIG. 1 showing the present splatter shield with its adjustable end panels in an almost fully retracted position.
Figure 3:
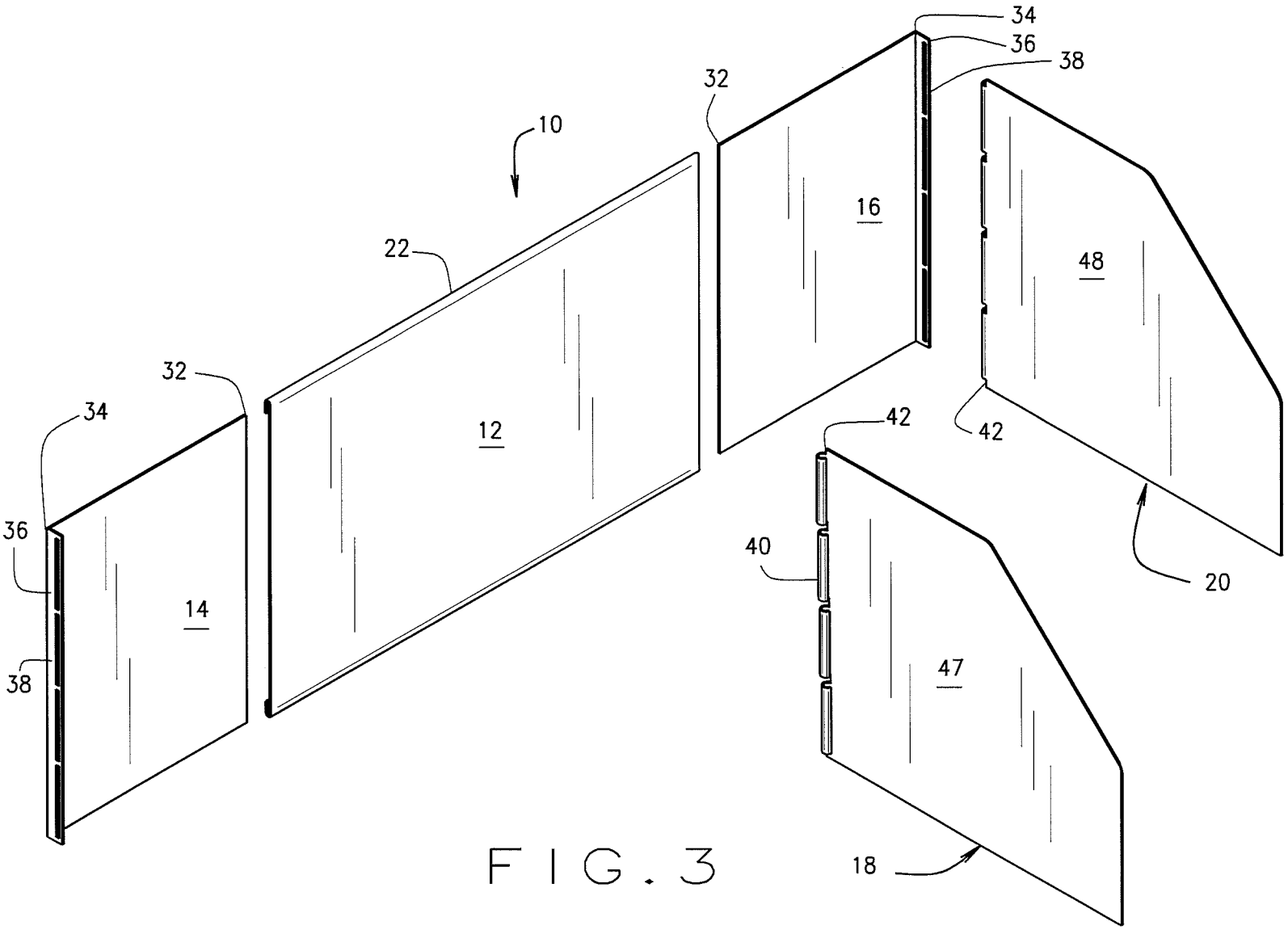
FIG. 3 is an exploded perspective view showing the present splatter shield in its disengaged orientation.
Figure 4:
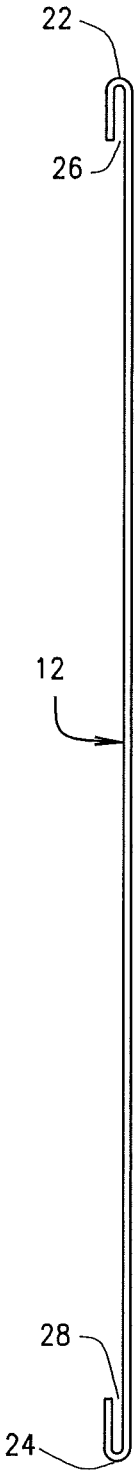
FIG. 4 is a side elevational view of the central panel showing the channel members at the top and bottom edge portions thereof.
Figure 5:
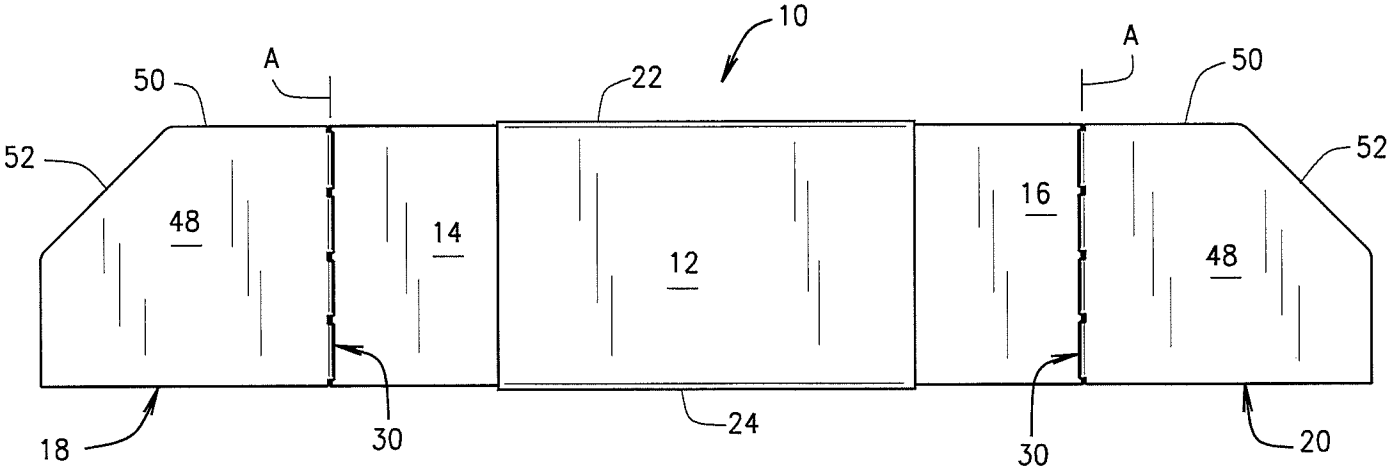
FIG. 5 is a front elevational view showing the present splatter shield in an extended position with its end panels in substantial alignment with the extension panels and the central panel.
Figure 6:
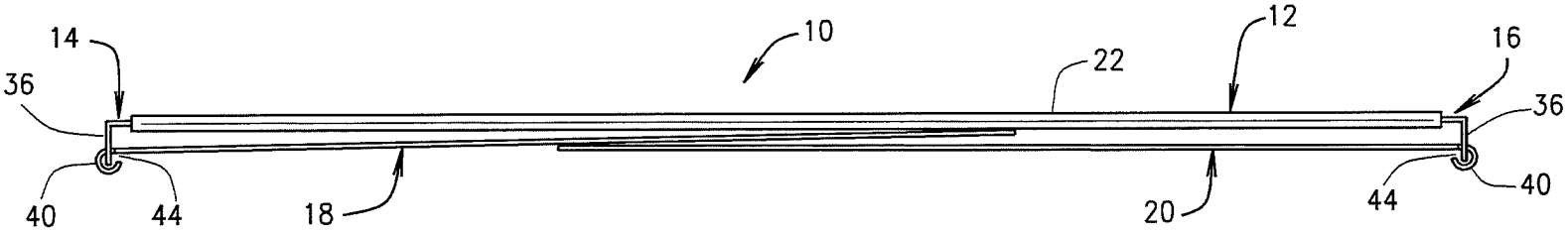
FIG. 6 is a top platform view of the splatter shield of FIG. 1 shown in a folded or collapsed storage condition.

Referring to the drawings more particularly by reference numbers wherein like numerals refer to like parts, the reference number 10 in FIGS. 1-10 identifies one embodiment of a splatter shield constructed in accordance with the teachings of the present invention. The present splatter shield 10 can be used in a variety of locations in a free-standing mode as best illustrated in FIGS. 1 and 5 and can be stored in a collapsed or folded condition as best illustrated in FIG. 6. The splatter shield 10 includes a central panel 12, a pair of extension panels 14 and 16, and a pair of end panels 18 and 20, all of which are generally planar. The central panel 12 includes a channel member 22 located adjacent the upper edge portion of the central panel 12 and a channel member 24 located adjacent the bottom edge portion of the central panel as illustrated in FIG. 4. Each channel member 22 and 24 can be formed by bending over the top and bottom edge portions of the central panel such that a channel space 26 and 28 respectively is formed as best shown in FIG. 4, the channel members 22 and 24 being configured to receive the top and bottom edge portions of the extension panels 14 and 16 within the respective channel spaces 26 and 28. The channel members 22 and 24 should be sufficient of depth to adequately hold the extension panels 14 and 16 therewithin for movement parallel to the central panel 12. Each channel member 22 and 24 may be one long channel member extending substantially along the top and bottom edge portions of the central panel as shown in FIGS. 1-6 and 10, or each channel member may include a plurality of spaced apart channel members positioned substantially along the top and bottom edge portions of the central panel 12, or each channel member may include a long channel member or a plurality of channel members extending along just a portion of the top and bottom edge portions of the central panel. Any combination of short and long channel members is anticipated and envisioned.

It is also recognized and anticipated that other constructions and/or attachments can be utilized to form the respective channel members 22 and 24.

The end panels 18 and 20 are hingedly connected to the respective extension panels 14 and 16 through an improved hinge connection 30. The end panels 18 and 20 are angularly movable relative to the respective extension panel 14 and 16 about the respective hinge connections 30 whereby the end panels 18 and 20 may be selectively positioned extending outwardly from the extension panels 14 and 16 as best illustrated in FIGS. 1, 2 and 5 to provide a freestanding splatter shield 10, or the end panels 18 and 20 may be positioned extending outwardly from the central panel 12 when the extension panels 14 and 16 are in their fully stored position behind the central panel 12. Because of the construction of the hinge connections 30 as will be further explained, the end panels 18 and 20 are likewise positionable at any intermediate angular orientation between a fully collapsed or folded storage position as best shown in FIG. 6 and a fully opened position as illustrated in FIG. 5. The hinge connections 30 permit the end panels 18 and 20 to pivot about the axis A which is generally parallel to the major plane of the end panels 18 and 20 and the extension panels 14 and 16 as best illustrated in FIGS. 1, 2, 5 and 10 and as described in detail below.

Figure 7:
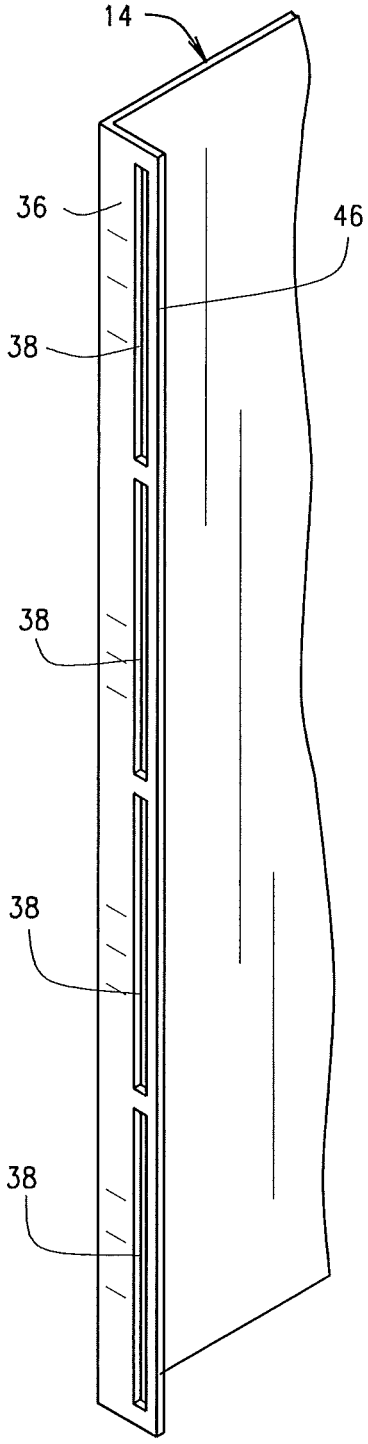
FIG. 7 is a partial perspective view illustrating one embodiment of the 90° flange member associated with one end portion of the extension panels.

The extension panels 14 and 16 are generally of the same construction and may be identical constructions if so desired. Each extension panel 14 and 16 includes first and second end portions 32 and 34, the first end portion 32 of each extension panel being configured so as to be slidably receivable within the channel spaces 26 and 28 associated with the channel members 22 and 24 located at the top and bottom edge portions of the central panel 12 as best illustrated in FIGS. 3 and 4. The respective top and bottom edge portions of each extension member are cooperatively slidably receivable within the respective channel spaces 26 and 28 such that each extension panel can be selectively movable relative to the opposite end portions of the central panel for selectively increasing and decreasing the overall length of the central panel as illustrated in FIGS. 1-3 and 5. Since there are no stop mechanisms or other devices associated with the first end portion 32 of each of the respective extension panels 14 and 16, each such extension panel can be totally removed from the respective channel members 22 and 24 for individual cleaning and maintenance as shown in FIG. 3. The second end portion 34 of each respective extension panel 14 and 18 includes a 90° flange member 36 as best illustrated in FIGS. 1-3 and 7. Each 90° flange member 36 includes at least one slot 38 extending therethrough and, in a preferred embodiment, includes a plurality of slots 38 extending therethrough as best illustrated in FIG. 7.

Figure 8:
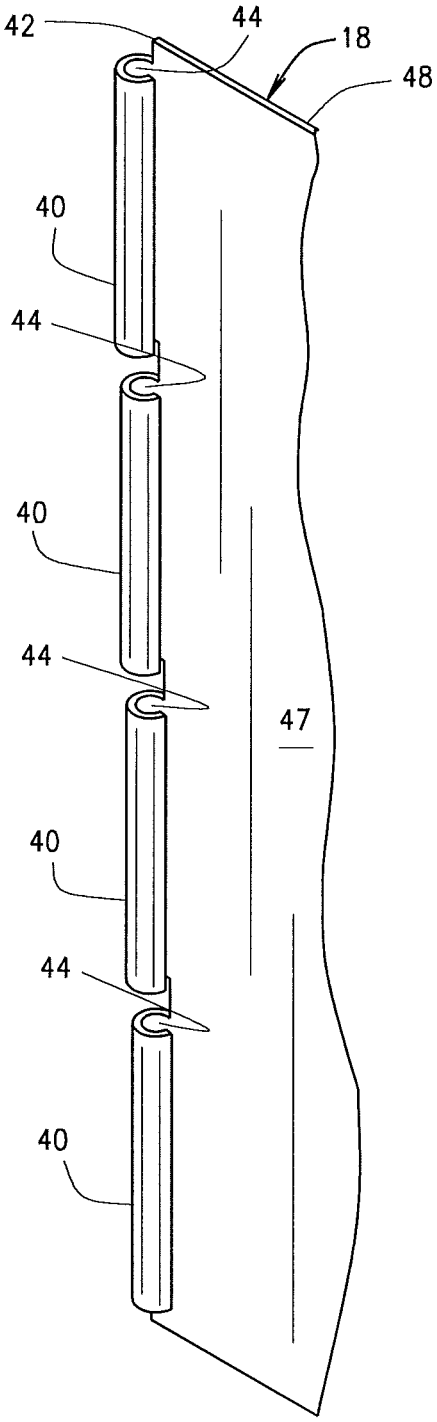
FIG. 8 is a partial perspective view illustrating one embodiment of the curved members associated with one end portion of the end panels.

The end panels 18 and 20 are likewise generally of the same construction and may be identical constructions if so desired. As best illustrated in FIGS. 3 and 8, each end panel 18 and 20 includes at least one curved member and, in a preferred embodiment, a plurality of curved members 40 associated with one end portion of each respective end panel 18 and 20, such as end portion 42. Each of the respective curved member(s) 40 are configured so as to fold back towards the respective end panel but the curved member(s) 40 stop short of the end panel thereby forming a gap 44 between each respective end panel and each respective curved member 40 as best illustrated in FIGS. 8 and 9A-9C. The curved member(s) 40 are configured and dimensioned so as to be received by the respective slots 38 associated with each of the 90° flange members 36.

Figure 9A:
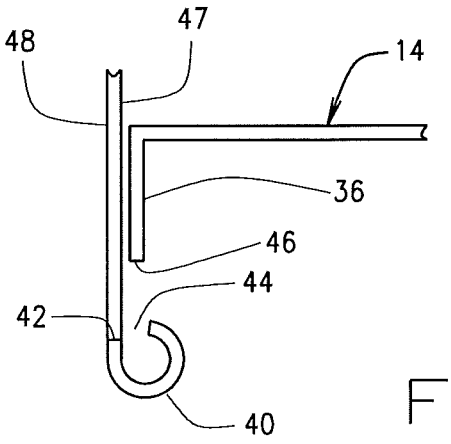
FIGS. 9A-C are top platform views showing how the end panels are attached to and disengaged from the extension panels.
Figure 9B:
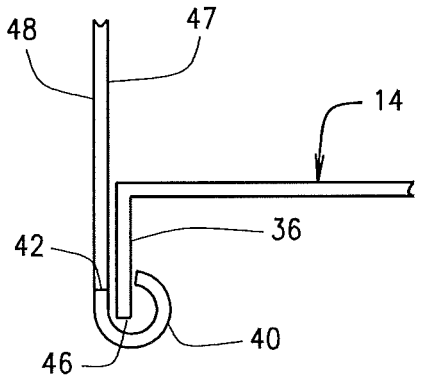
Figure 9C:
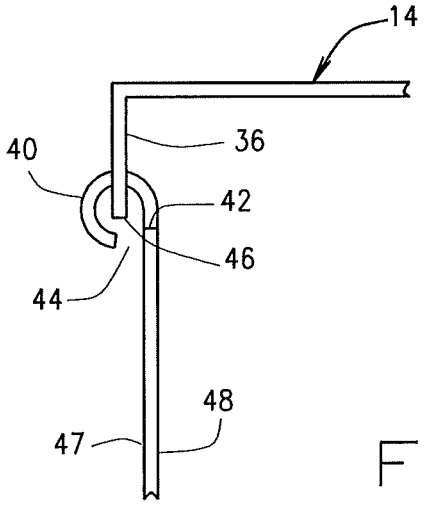

In use, the terminal end portion 46 of each 90° flange member 36 is positioned in the corresponding gap 44 associated with each end panel 18 and 20 and each end panel is then rotated so that the curved member(s) 40 are cooperatively received within the corresponding slot(s) 38 associated with each of the 90° flange members 36 as best shown in FIGS. 9A-9C. When the curved member(s) 40 of the respective end panels 18 and 20 are received within the corresponding slots 38 associated with the extension panels 14 and 16, the respective end panels 18 and 20 are both movable relative to their respective extension panel between a first position wherein the respective end panels overlay or lie flat on top of the central panel 12 and the respective extension panels 14 and 16 as best illustrated in FIG. 6 and a second position angularly related thereto as illustrated in FIGS. 1, 2 and 5. Selectively positioning the respective end panels 18 and 20 at a plurality of different angular orientations relative to the central panel 12 and relative to the extension panels 14 and 16, and selectively moving the respective extension panels 14 and 16 relative to the central panel allows a user to selectively accommodate different work areas regardless of the length, width or other configuration of the particular work area.

Figure 10:
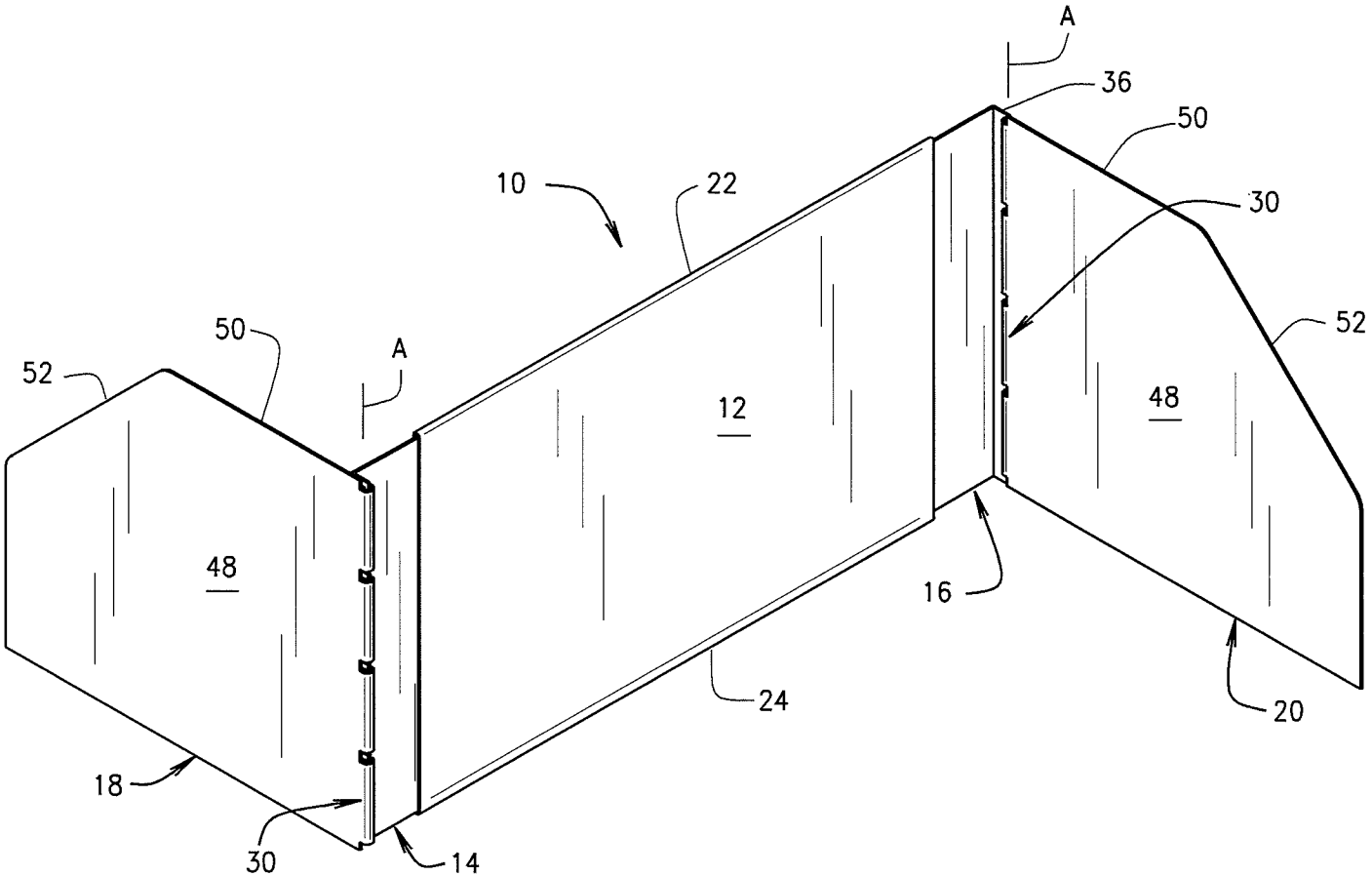
FIG. 10 is a perspective view illustrating the positioning of one of the end panels relative to its extension panel for disengaging the end panel from its respective extension panel.

In addition, each of the respective end panels 18 and 20 can be further moved or rotated to a position where the respective end panel lies in the same plane as the 90° flange member associated with its respective extension panel as illustrated in FIG. 10 thereby allowing the 90° flange member 36 associated with each respective extension panel 14 and 16 to again be positioned in the corresponding gap 40 located between the respective end panels and their corresponding curved member(s) 40. This positioning is illustrated in FIGS. 9A, 9B and 10 and allows the respective end panels 18 and 20 to be both engaged with and disengaged from the 90° flange members 36 associated with the respective extension panels 14 and 16. This allows a user to completely disassemble the present splatter shield 10 such that the individual components, namely, the central panel 12, the extension panels 14 and 16, and the end panels 18 and 20 are each separately disconnected from the assembled unit such that each individual component can be separately cleaned apart from each other. This allows a user to fully disengage the present splatter shield 10 such that any dirt, grease and other debris or food particles which may collect within the spaces formed by and between the central panel 12, the extension panels 14 and 16, and the end panels 18 and 20 can be adequately cleaned. The present hinge connection 30 is formed by cooperatively receiving the plurality of curved member(s) 40 associated with the respective end panels 18 and 20 within the plurality of slot(s) 38 associated with the respective 90° flange members 36 associated with the extension panels 14 and 16.

In addition, each end panel 18 and 20 is generally planar having main planar surfaces 47 and 48 that are generally parallel to one another as best illustrated in FIGS. 1-3 and 9A-9C. Each end panel 18 and 20 has a top edge portion 50 having a generally horizontal run as best illustrated in FIGS. 1-3, 5 and 10, and it likewise has an inclined top edge portion 52 as likewise best illustrated in FIGS. 1-3, 5 and 10. It is recognized and anticipated that the top edge portions 50 and 52 of each end panel 18 and 20 may take on a wide variety of different slopes, shapes or contours. The end panels 18 and 20 are again each hingedly removably connected to a respective extension panel 14 and 16 via the hinge connections 30 as explained above.

Figure 11:
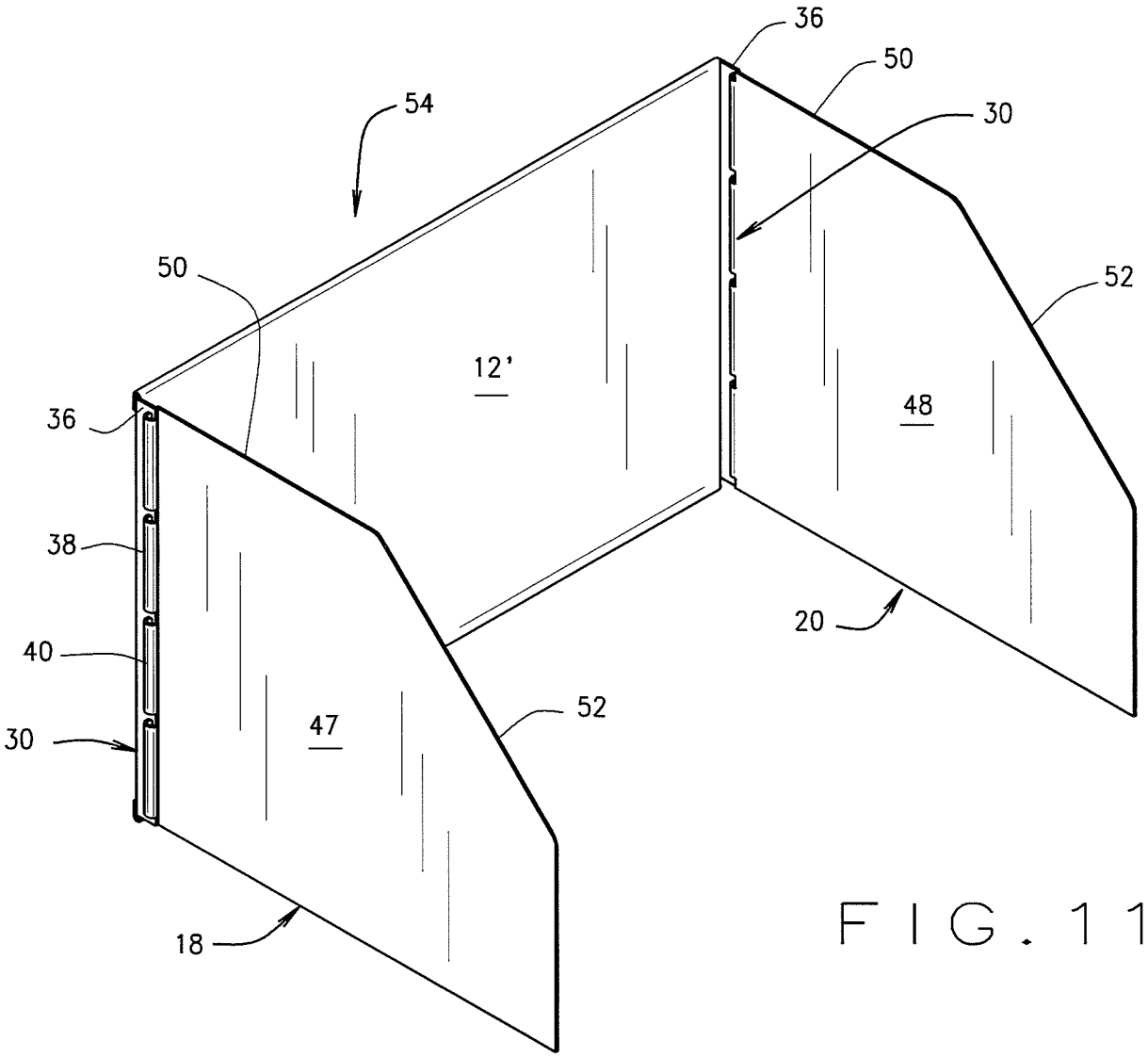
FIG. 11 is a perspective view illustrating another embodiment of the present splatter shield with no extension panels.

It is also important to recognize that the present splatter shield 10 can be utilized without extension panels 18 and 20, in which case the central panel 12 would not be adjustable lengthwise, but end panels 18 and 20 would still be selectively angularly positionable at a plurality of different angular orientations relative to the central panel 12 as previously explained. In this particular embodiment as illustrated in FIG. 11, the opposite end portions of the central panel 12' would each include the 90° flange member 36 and its associated slot(s) 38 for engagement with the plurality of curved member(s) 40 associated with the respective end panels 18 and 20.

Figure 12:
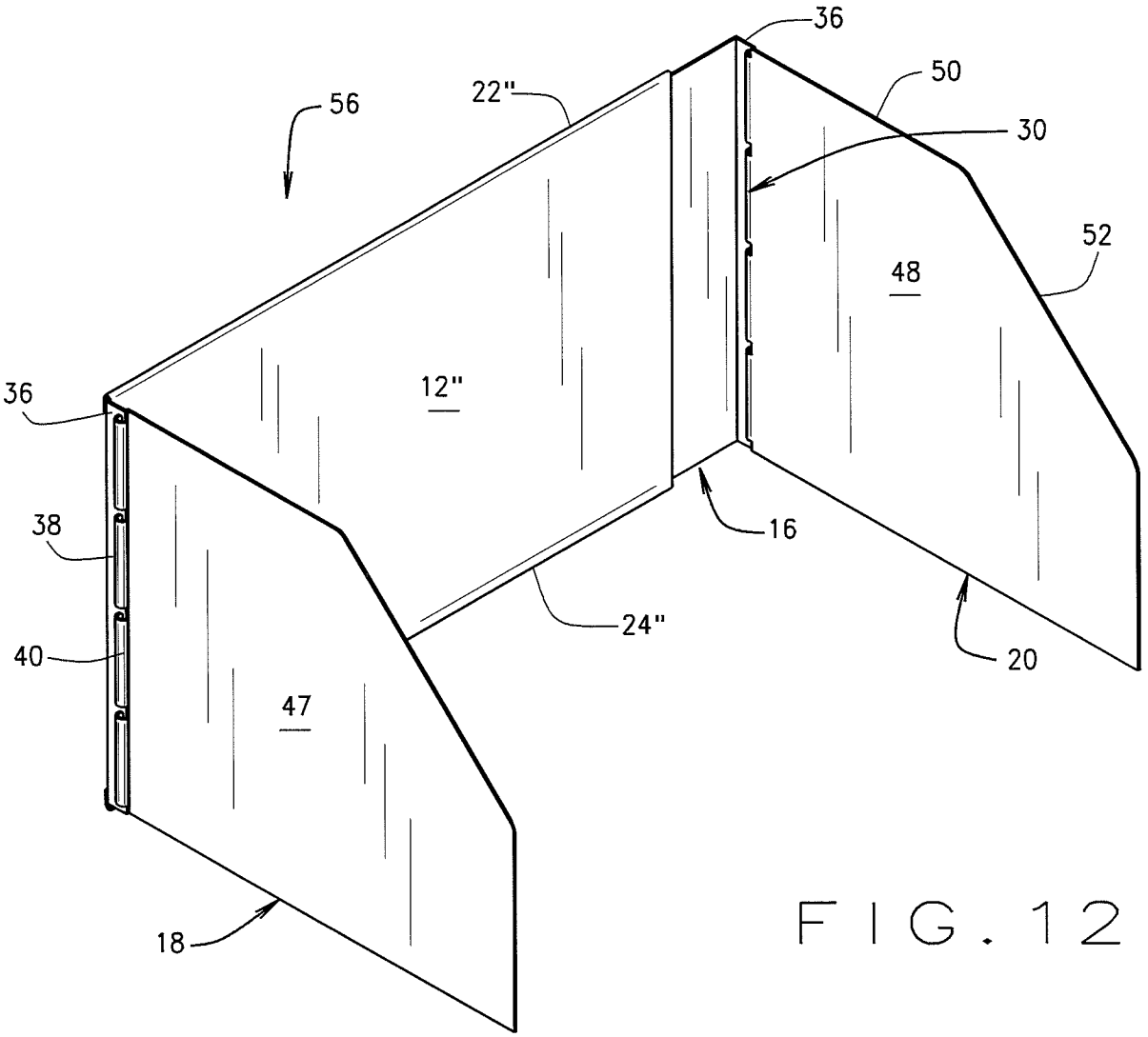
FIG. 12 is a perspective view illustrating still another embodiment of the present splatter shield with only one extension panel attached to one end portion of the central panel.

It is also recognized and anticipated that only one end portion of the central panel 12 may include one of the extension members 14 or 16. In this particular embodiment as illustrated in FIG. 12, one end portion of the central panel 12" would include a channel member 22" located adjacent the upper edge portion of one end portion of the central panel 12" and a channel member 24" located adjacent the bottom edge portion of the same end portion of the central panel as illustrated in FIG. 12. This would enable one end portion of the central panel 12" to be adjustable to increase or decrease its overall length whereas the opposite end portion of the central panel 12" would be hingedly connected directly to one of the end panels 18 or 20. Here again, this opposite end portion of the central panel 12" would include the 90° flange member 36 and its associated slot(s) 38 for receiving the curved member(s) 40 associated with that respective end panel as best illustrated in FIG. 12.

Still other configurations and arrangements for adjustably changing the overall length of the central panel 12 are anticipated and recognized so long as the extension panels and end panels are removable from each other as explained above.

Still further, the present splatter shields 10, 54 and 56 can likewise be utilized on a conventional countertop and a typical electrical appliance such as a mixer can be positioned between the end panels 18 and 20 and the central panel to prevent the contents within the mixing bowl from splattering outside the confines of the splatter shield. Similarly other electrical appliances such as a wok, a deep fryer, a blender or other appliances can likewise be positioned within the confines of the present splatter shield.

Still further, regardless of the specific type of material utilized for fabricating the present splatter shields 10, 54 and 56, it is preferred that such material be heat and flame resistant. It is also preferred that the panels 12, 12', 12", 14, 16, 18 and 20 be non-porous and non-absorbent so as to be odor resistant and that such panels be made of the material having a stick-free surface. Still further, it is also preferred that the material forming panels 12, 12', 12", 14, 16, 18 and 20 be bacteria resistance or that such materials can be treated so as to be bacteria resistant.

It is also preferred that the material forming the present splatter shields cleans easily with soap and water. It is also anticipated that the present splatter shields can be provided in a variety of different colors and textures to accommodate the motif and décor associated with kitchens and cooking areas in all environments.

It is also recognized that the present splatter shields, when used in conjunction with a gas or electric stove positioned or located within a center island or other island or countertop location within a kitchen, serves as an additional safety device since it prevents hot food, grease, oil or other cooking items from splattering into an open area behind the island stove, which hot splatter may injure passing or standing individuals or may cause damage to the surrounding furniture or floor coverings. Other advantages and benefits from using the present splatter shield 10 are envisioned and can be obtained from a study of the present disclosure.

As is evident from the foregoing description, certain aspects of the present invention are not limited by the particular details of the examples illustrated herein and it is therefore contemplated that a wide variety of other applications and uses of the present splatter shield will occur to those skilled in the art.

Thus, there has been shown and described a novel freestanding improved splatter shield which fulfills all of the objects and advantages sought therefor. Many changes, modifications, variations and other uses and applications of the present splatter shield, or equivalents thereof, will become apparent to those skilled in the art after considering this specification and the accompanying drawings. All such changes, modifications, variations, and other uses and applications which do not depart from the spirit and scope of the present invention are deemed to be covered by the invention which is limited only by the claims which follow.

The invention claimed is:

1. A freestanding splatter shield for use in kitchens and other work areas comprising:

a central panel having opposite first and second end portions, each of said opposite first and second end portions including a 90° flange member, each 90° flange member including at least one slot extending therethrough;

a first end panel removably engageable with the 90° flange member associated with the first end portion of said central panel, said first end panel having at least one curved member associated with one end portion thereof, said at least one curved member folding back towards said first end panel and forming a gap between said first end panel and said at least one curved member, said at least one curved member being configured so as to be received by the at least one slot associated with the 90° flange member of the first end portion of said central panel, said first end panel being movable between a first position wherein the first end panel overlays the central panel and a second position angularly related thereto, said second position being at an angle greater than 90° from said first position, said first end panel being further movable to a position wherein the first end panel lies in the same plane as the 90° flange member whereby the first end panel can be disengaged from the first end portion of said central panel;

a second end panel removably engageable with the 90° flange member associated with the second end portion of said central panel, said second end panel having at least one curved member associated with one end portion thereof, said at least one curved member folding back towards said second end panel and forming a gap between said second end panel and said at least one curved member, said at least one curved member being configured so as to be received by the at least one slot associated with the 90° flange member of the second end portion of said central panel, said second end panel being movable between a first position wherein said second end panel overlays the central panel and a second position angularly related thereto, said second position being at an angle greater than 90° from said first position, said second end panel being further movable to a position wherein the second end panel lies in the same plane as the 90° flange member whereby said second end panel can be disengaged from the second end portion of said central member;

said first and second end panels being selectively positionable at a plurality of different angular orientations relative to said central panel to selectively accommodate different work areas.

2. The splatter shield defined in claim 1 wherein each of said 90° flange members associated with the opposite first and second end portions of said central panel include a plurality of slots extending therethrough, and wherein the at least one curved member associated with each of said first and second end panels includes a plurality of curved member associated with one end portion respectively thereof, said plurality of curved members being configured to be received by the plurality of slots associated with the 90° flange members of said central panel.

3. The splatter shield defined in claim 1 wherein said central panel and said first and second end panels are made of a metal material.

4. The splatter shield defined in claim 1 wherein said central panel and said first and second end panels are made of a polymeric material.

5. A freestanding splatter shield for use in kitchens and other work areas comprising:

a central panel having top and bottom edge portions and opposite first and second end portions, one of said first and second end portions including a 90° flange member, said 90° flange member including at least one slot extending therethrough, at least a portion of said top and bottom edge portions of said central panel associated with the other of said first and second opposite end portions each including a channel member;

a first end panel removably engageable to the 90° flange member associated with one of said first and second end portions of said central panel, said first end panel having at least one curved member associated with one end portion thereof, said at least one curved member folding back towards said first end panel and forming a gap between said first end panel and said at least one curved member, said at least one curved member being configured so as to be received by the at least one slot associated with the 90° flange member, said first end panel being movable between a first position wherein the first end panel overlays the central panel and a second position angularly related thereto, said second position being at an angle greater than 90° from said first position, said first end panel being further movable to a position wherein the first end panel lies in the same plane as the 90° flange member whereby said first end panel can be disengaged from said one of said first and second end portions of said central panel;

an extension member having opposite first and second end portions, one of said first and second end portions being receivable within the respective channel members associated with the top and bottom edge portions of said central panel, the other of said first and second end portions including a 90° flange member having at least one slot extending therethrough;

a second end panel removably engageable with the 90° flange member associated with said extension panel, said second end panel having at least one curved member associated with one end portion thereof, said at least one curved member folding back towards said second end panel and forming a gap between said second end panel and said at least one curved member, said at least one curved member being configured so as to be received by the at least one slot associated with the 90° flange member of said extension panel, said second end panel being movable between a first position wherein said second end panel overlays the central panel and said extension panel and a second position angularly related thereto, said second position being at an angle greater than 90° from said first position, said second end panel being further movable to a position wherein the second end panel lies in the same plane as the 90° flange member associated with said extension panel whereby said second end panel can be disengaged from said extension panel;

said first and second end panels being selectively positionable at a plurality of different angular orientations relative to said central panel and said extension panel to selectively accommodate different work areas; and wherein said extension panel is selectively movable relative to said central panel for selectively increasing and decreasing the length of said central panel, said extension panel being removable from said central panel.

6. The splatter shield defined in claim 5 wherein the 90° flange member associated with one of said first and second opposite end portions of said central panel includes a plurality of slots extending therethrough, and wherein the at least one curved member associated with the one end portion of said first end panel includes a plurality of curved members configured to be received by the plurality of slots associated with the 90° flange member of said central panel.

7. The splatter shield defined in claim 5 wherein the 90° flange member associated with the one end portion of said extension panel includes a plurality of slots extending therethrough, and wherein the at least one curved member associated with one end portion of said second end panel includes a plurality of curved members configured so as to be received by the plurality of curved members associated with the 90° flange member of said extension panel.

8. The splatter shield defined in claim 5 wherein said central panel, said first and second end panels, and said extension panel are made of a metal material.

9. The splatter shield defined in claim 5 wherein said central panel, said first and second end panels, and said extension panel are made of a polymeric material.

10. A freestanding splatter shield for use in kitchens and other work areas comprising:

a central panel having top and bottom edge portions and opposite first and second end portions, said top and bottom edge portions each including at least one channel member associated respectively with the first and second end portions of said central panel;

a first extension panel having first and second end portions, said first end portion being configured to be received within the at least one channel member associated with the top and bottom edge portions of the first end portion of said central panel, said first extension panel being selectively movable relative to the first end portion of said central panel for selectively increasing and decreasing the length of said central panel, said first extension panel being removable from said central panel, and the second end portion of said first extension member including a 90° flange member having at least one slot extending therethrough;

a second extension member having opposite first and second end portions, said first end portion of said second extension member being configured to be received within the at least one channel member associated with the top and bottom edge portions of the second end portion of said central panel, said second extension member being selectively movable relative to the second end portion of said central panel for selectively increasing and decreasing the length of said central panel, said second extension panel being removable from said central panel, and the second end portion of said second extension panel including a 90° flange member having at least one slot extending therethrough;

a first end panel removably engageable with the 90° flange member associated with said first extension panel, said first end panel having at least one curved member associated with one end portion thereof, said at least one curved member folding back toward said first end panel and forming a gap between said first end panel and said at least one curved member, said at least one curved member being configured so as to be received by the at least one slot associated with the 90° flange member of said first extension panel, said first end panel being movable between a first position wherein the first end panel overlaps the central panel and the first extension panel and a second position angularly related thereto, said second position being at an angle greater than 90° from said first position, said first end panel being further movable to a position wherein the first end panel lies in the same plane as the 90° flange member of said first extension panel whereby said first end panel can be disengaged from the 90° flange member of said first extension panel;

a second end panel removably engageable with the 90° flange member associated with the second extension panel, said second end panel having at least one curved member associated with one end portion thereof, said at least one curved member folding back towards said first end panel and forming a gap between said second end panel and said at least one curved member, said at least one curved member being configured so as to be received by the at least one slot associated with the 90° flange member of said second extension panel, said second end panel being movable between a first position whereby the second end panel overlaps the central panel and said second extension panel and a second position angularly related thereto, said said second position being at an angle greater than 90° from said first position, said second end panel being further movable to a position wherein the second end panel lies in the same plane as the 90° flange member of said second extension panel whereby said second end panel can be disengaged from the 90° flange member of said second extension panel;

said first and second end panels being selectively positionable at a plurality of different angular orientations relative to said central panel and relative to said first and second extension panels to selectively accommodate different work areas.

11. The splatter shield defined in claim 10 wherein the 90° flange members associated with said first and second extension panels each include a plurality of slots extending therethrough, and wherein the at least one curved member associated with each of said first and second end panels includes a plurality of curved members configured so as to be received by the plurality of slots associated with said 90° flange members.

12. The splatter shield defined in claim 10 wherein the central panel, said first and second end panels, and said first and second extension panels are made of a metal material.

13. The splatter shield defined in claim 10 wherein said central panel, said first and second end panels, and said first and second extension panels are made of a polymeric material.

14. The splatter shield defined in claim 10 wherein the 90° flange member of said first extension panel is receivable within the gap formed between the first end panel and the at least one curved member of said first end panel when said first end panel is moved to a position wherein the first end panel lies in the same plane as the 90° flange member of said first extension panel.

15. The splatter shield defined in claim 10 wherein the 90° flange member of said second extension panel is receivable within the gap formed between the second end panel and the at least one curved member of said second end panel when said second end panel is moved to a position wherein the second end panel lies in the same plane as the 90° flange member of said second extension panel.

* * * * *